United States Patent [19]

May

[11] Patent Number: 5,033,255

[45] Date of Patent: Jul. 23, 1991

[54] CARTON PACKAGING MACHINE

[75] Inventor: Edward G. May, Leeds, England

[73] Assignee: Bonar Cooke Cartons Limited, Manchester, England

[21] Appl. No.: 377,840

[22] PCT Filed: Dec. 4, 1987

[86] PCT No.: PCT/GB88/00876

§ 371 Date: Jul. 18, 1989

§ 102(e) Date: Jul. 18, 1989

[87] PCT Pub. No.: WO88/04259

PCT Pub. Date: Jun. 16, 1988

[30] Foreign Application Priority Data

Dec. 6, 1986 [GB] United Kingdom ..... 8629245

[51] Int. Cl.[5] ..... B65B 11/10

[52] U.S. Cl. ..... 53/564; 53/48.1; 53/207

[58] Field of Search ..... 53/564, 48, 458, 457, 53/462, 207

[56] References Cited

U.S. PATENT DOCUMENTS

| | | | |
|---|---|---|---|
| 2,812,939 | 11/1957 | Harred | 271/44 |
| 2,953,070 | 9/1960 | Dunning | 53/48 X |
| 2,998,685 | 9/1961 | Ganz | 53/48 X |
| 3,016,668 | 1/1962 | Sell | 53/48 X |
| 3,234,706 | 2/1966 | Arneson | 53/48 |

FOREIGN PATENT DOCUMENTS 0149351 7/1985 European Pat. Off. .

*Primary Examiner*—James F. Coan

*Attorney, Agent, or Firm*—Merchant, Gould, Smith, Edell, Welter & Schmidt

[57] ABSTRACT

A carton-packaging machine (10) which causes progressive erection of carton sleeves from a supply of blanks (11) in a magazine (19), the partly erected blanks being loaded with product (24, 25) and then being closed in the form of a sleeve around the product. An endless conveyor (12) moves the blank through a blank supply station (14), an erection station (15), a product loading stations (16), a folding station (17) and a discharge stations (18), and a suction device (20) cooperates with the magazine (19) in order to draw individual blanks in flat form into the path of travel of the conveyor (12) for engagement thereby. A shaping device (21) at the erection station (15) forms each blank into U-shaped form and which is then advanced by the conveyor to the loading station (16) for loading with product (24, 25). Overhead folding rods (34, 35, 36) at the folding station (17) engage the upper portions (**25*a*, 23*b*) of the side flaps (23**) of the blank in order to fold the side flaps inwardly into overlapping relation, with a line of adhesive therebetween, in order to complete the formation of the carton sleeve.

5 Claims, 7 Drawing Sheets

CARTON PACKAGING MACHINE

This invention relates to a carton packaging machine which is operable to cause progressive erection of carton-forming blanks, to permit loading of the partly erected blanks with product, to complete the formation of each carton and to close the latter with the product located therein, and to discharge each closed carton from the machine.

The invention is particularly concerned with a machine for use in forming carton sleeves, such machines being known as "sleeving machines". In machines of this type, a stack of blanks is supplied to the machine, and the blanks are fed singly to the machine and then undergo progressive erection, loading with product, final formation into sleeve form, and then discharge of the sleeved product.

Existing designs of sleeving machine wrap the blank around the product by drawing the blank downwardly onto the top of the product and by folding sides of the blank downwardly so as to lie alongside the product, and then by folding the lower margins of the side of the blank under the product, followed by sealed closure. This manipulation of the blank is somewhat complicated, and it is a particularly difficult part of the operation to ensure that the blank is folded under the product and then secured by adhesive in a satisfactory manner.

In the known machine, the wrapping of the blank around the product is done entirely by the machine, and any incorrect initial positioning of the product, or improper presentation of the blank to the product, cannot be corrected manually by an operator, and the machine is therefore liable to form sleeved packaging which is not always satisfactory, and particularly does not hold the product securely, if the bottom closing and sealing operation has not been completed satisfactorily.

There are standard tests for packaging, one of which requires that the packaging should not be damaged, and neither should the product become loose or dislodged, following dropping of the packaging from a standard height onto a hard surface. Existing designs of sleeving machine do not always achieve a satisfactory and repeatable operating performance in the formation of sleeve cartons, such as to meet the standard tests.

The invention therefore seeks to provide a carton packaging machine which handles the blanks in a different way, such that more readily repeatable sleeve closure of the blank around a product can be achieved.

According to the invention there is provided a carton-packaging machine which is operable to cause progressive erection of carton sleeves from a supply of blanks, to permit loading of partly erected blanks with product, to complete the formation of a sleeve around each product and to close the latter with the product located therein, and to discharge the loaded sleeve from the machine, in which the machine comprises:

an endless conveyor movable progressively through a blank-supply station, an erection station, a product-loading station, a folding station, and a discharge station;

a magazine arranged at the blank-supply station for holding a stack of blanks;

a suction device arranged to co-operate with the magazine and to operate in timed sequence with the operation of the conveyor in order to engage and to draw blanks individually in turn, in flat form, into the path of travel of the conveyor for engagement thereby;

a shaping device arranged at the erection station and engageable by each blank in order to form the blank into a U-shape having a base and a pair of side flaps extending upwardly from the base, each U-shaped blank being then advanced by the conveyor to the loading station at which product can be loaded onto the base; and a folding device arranged at the folding station above the conveyor and engageable with the upper portion of the side flaps, as each loaded blank is advanced to the folding station, so as to fold the side flaps inwardly into overlapping relation in order to complete the formation of the carton sleeve.

The packaging machine according to the invention operates to form carton sleeves in a novel manner, in that the product can be loaded downwardly into the partly erected cartons, and this permits the product to be located in desired positions readily especially when, as is preferred, loading takes place by hand.

The formation of the carton sleeve is thus completed by inwardly folding the side flaps over the top of the product, and this operation is much more readily carried out in a satisfactory and repeatable manner, than by the known technique of underside closure.

Permanent closure of each carton sleeve may take place in any convenient manner, such as by providing pre-formed adhesive strips on one or both of the side flaps of each blank. However, it is preferred that sealed closure takes place by arranging an adhesive applicator so as to co-operate with the folding device in order to form a line of adhesive on the underlying one of the overlapping side flaps, prior to final pressing-down of the uppermost flap.

One preferred adhesive applicator comprises a hot melt adhesive jetting device which delivers, in timed sequence, a line of adhesive which has the property of forming a permanent closure fairly rapidly i.e. by the time the carton sleeve has left the folding station and is on its way to the discharge station.

In order to achieve an orderly supply of blanks, one by one, into the path of the conveyor, it is preferred to arrange the magazine so that is has two separate guide portions, a first of which extends substantially vertically upwardly from the path of travel of the conveyor, and a second of which extends upwardly and rearwardly with respect to the direction of travel of the conveyor. By this arrangement of the magazine, the blanks undergo relative longitudinal displacement as they descend through the second guide part to the first guide part, and this feature assists in the separation of the blanks so as to prevent them from adhering to each other by friction, partial vacuum, or board interlocking so that they can readily be discharged one by one from the first guide part into the path of travel of the conveyor.

In order to advance the blanks through the various operating stations in a reliable manner, it is preferred that the conveyor takes the form of a slatted conveyor having upwardly projecting flights spaced apart along the length of the conveyor.

Preferably, rails extend alongside and above the upper run of the conveyor, the rails serving to support the base of the carton-blank as it undergoes erection during travel along the conveyor.

The carton sleeves will be shaped into any suitable form, according to the type of product which is to be loaded therein. By way of example only, product which can be loaded in the sleeves include cans, such as tins of cat food, foil packed product, such as jam sponges, and plastic containers, such as yoghurt packs. The product may comprise single items, each contained in its own sleeved carton, or a series of product may be loaded into each carton. Indeed, in a preferred arrangement, two tier arrangements of product may be arranged in each carton sleeve.

An embodiment of carton-packaging machine according to the invention will not be described in detail, by way of example only, with reference to the accompanying drawings, in which:

FIG. 1 is a diagramatic side view of a sleeve-forming packaging machine according to the invention;

FIGS. 2*a* and 2*d* show successive stages in the erection and closure of a carton sleeve by the machine;

Figure 1:
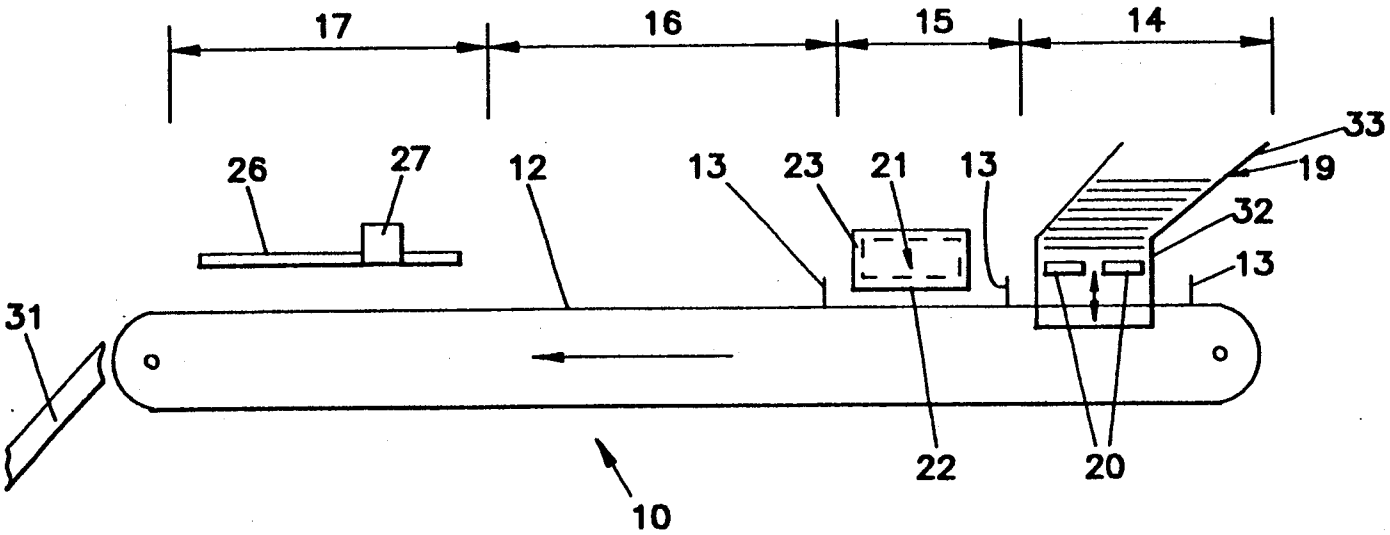
Figure 2A:
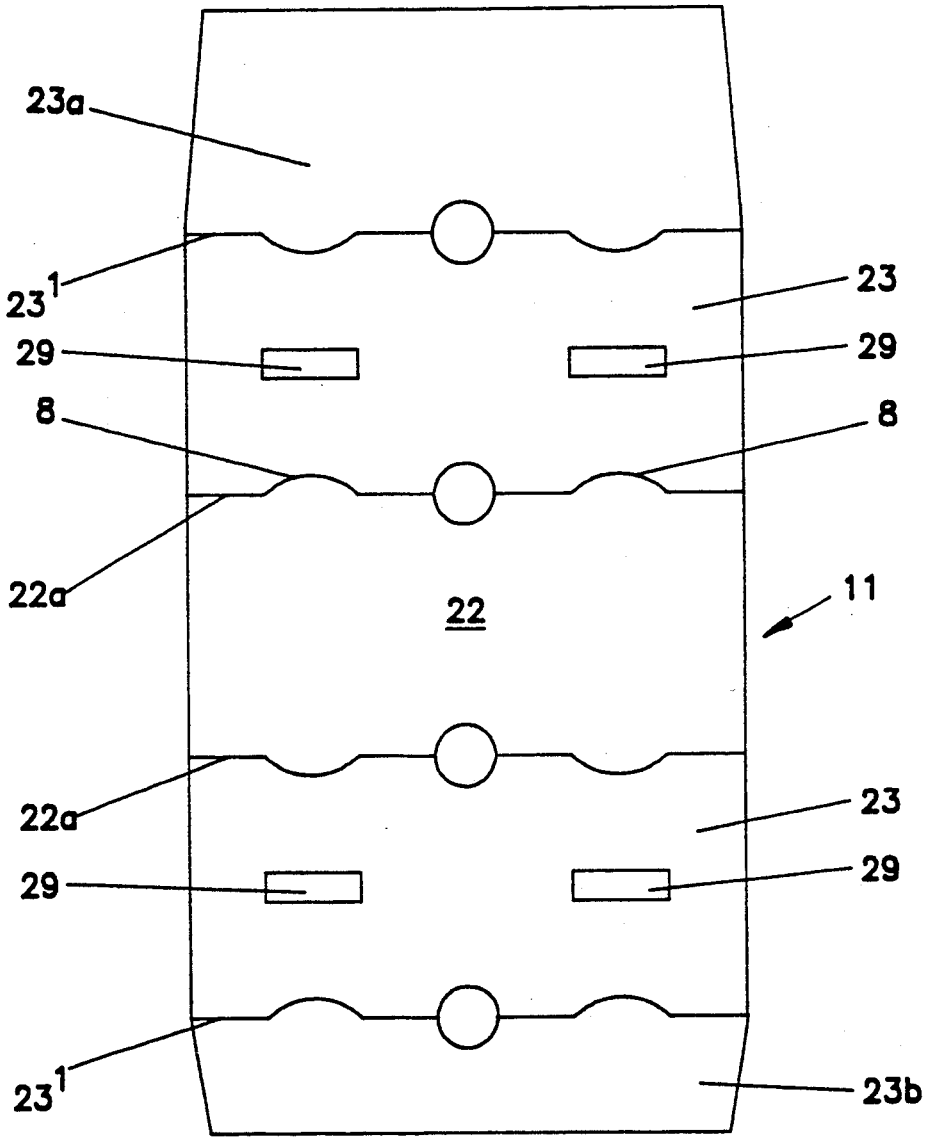
Figure 2B:
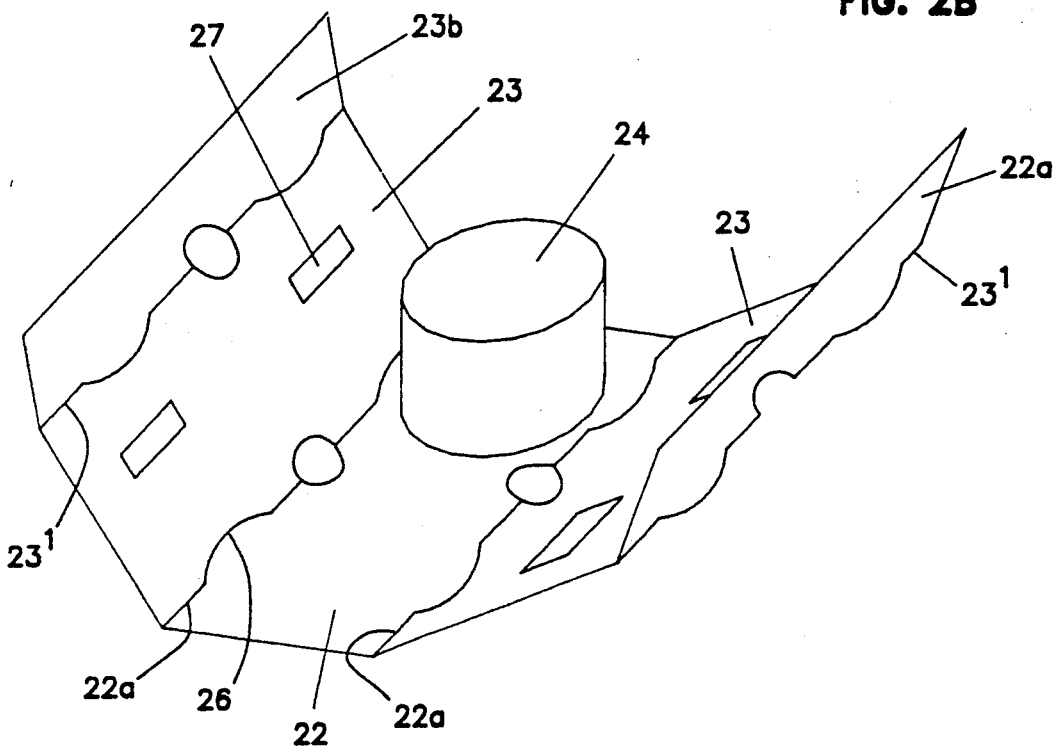
Figure 2C:
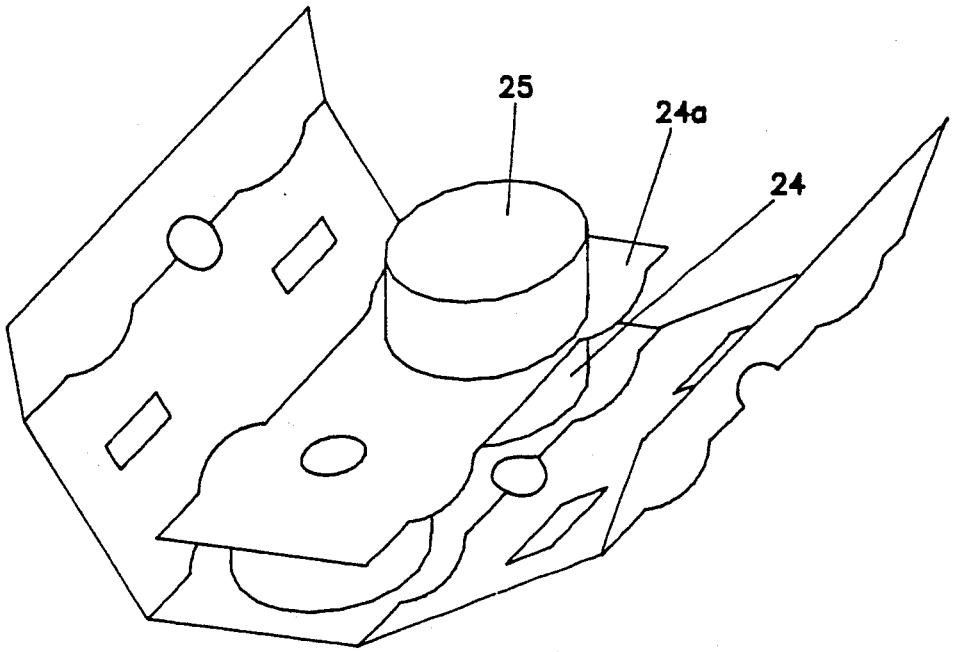
Figure 2D:
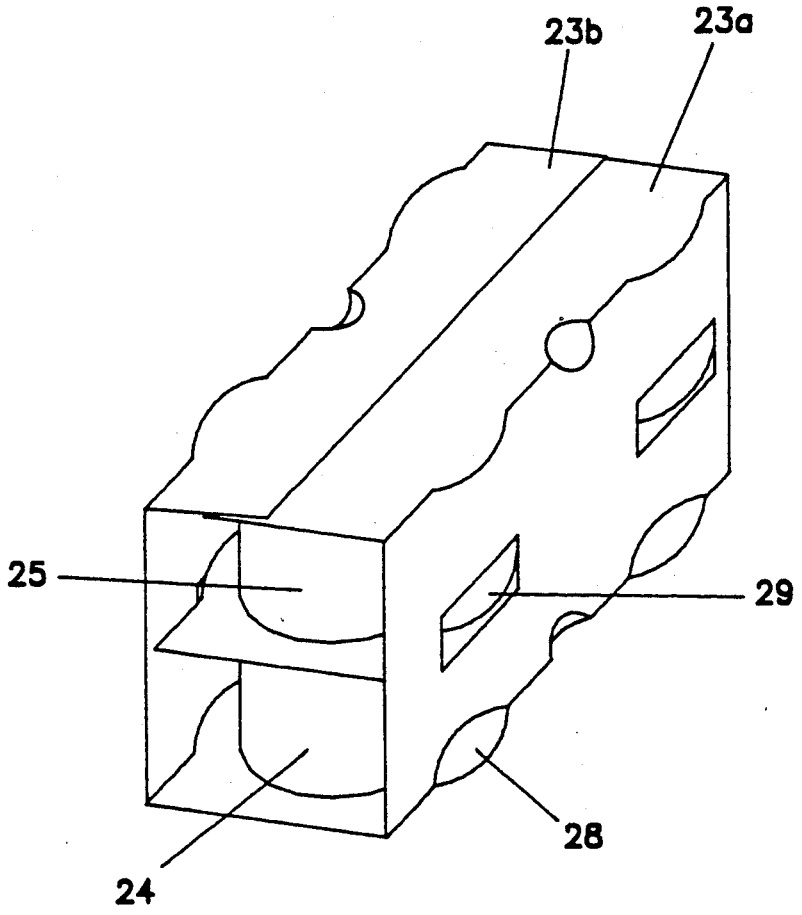

Referring now to FIG. 1 of the drawings, a carton-packaging machine according to the invention is designated generally by reference 10, and which is operable to cause progressive erection of a carton sleeve from a blank 11, as shown in FIG. 2*a*, to permit loading of partly erected blanks with product, as shown in FIGS. 2*b* and *c*, to complete the formation of the sleeve around the product, as shown in FIG. 2*d*, and to close the carton sleeve with the product located therein, and to discharge the loaded sleeve to a discharge station.

The machine 10 comprises an endless conveyor 12 in the form of a slatted conveyor having upwardly extending flights 13 which serve to advance each blank 11 through its various treatment stations. The slatted conveyor 12 runs below a pair of horizontally spaced rails 12*a* (see FIGS. 3, 4 and 5) on which the blank is supported during its movement by the conveyor from one station to another while appropriate action takes place at each station. Thus, as shown in FIG. 1, the upper run of the conveyor 12 is movable progressively through a carton blank-loading station 14, an erection station 15, a product-loading station 16, a folding station 17 and a discharge station 18.

A magazine 19 is arranged at the station 14 for holding a stack of blanks 11, and a suction device 20 is arranged to co-operate with the magazine 19 and to operate in timed sequence with the operation of the conveyor 12 in order to engage and to draw blanks 11 individually in turn, in flat form, into the path of travel of the flights 13 of the conveyor 12 for engagement thereby.

A plough shaped forming device 21 (shown only diagramatically in FIG. 1) is arranged at the erection station 15 so as to be engaged by each flat blank 11 as it is advanced by the conveyor 12 to the station 15, and operates in order to form the blank into a U-shape. The forming device 21 is a plough-type device known per se in the erection of cartons from blanks, and it causes the blanks to fold upwardly about fold lines 22*a* (see FIGS. 2*a* to 2*d*) extending alongside a base 22, and so as to form two upwardly extending side flaps 23.

FIG. 2*d* shows the blank 11 is partly erected form, and also shows a product container 24 thereon. However, the loading of the erected blank will only take place after advancement of the blanks by the conveyor 12 to the loading station 16. This loading can take place by automatic product-feeding devices (not shown), or by manual insertion of the product by one of more operators standing at the station 16.

The product is particularly suitable for loading and location in position, since it has an essentially stable shape.

FIG. 2*b* shows a single product 24 in the partly erected blank, but two or more products can be loaded in a single row on the base 22. The side flaps 23 can then be retained in position by folding-over the edge flaps 23*a* and 23*b* about fold lines $23^1$ and adhesively securing together the edge flaps at station 17.

A single row or layer of product can be loaded into the partly erected carton of FIG. 2*b*, but it two layers of product are required, then a spacer plate 24*a* can be fitted, as shown in FIG. 2*c*, which forms a base onto which a further layer of product can be loaded, as shown in FIG. 2*c*. The closure of the carton can be as just described, and a longitudinal restraint to movement of the product is obtained by engagement of projecting portions of the lower rims of the product 24 and 25 through cut-outs 26 and 27 formed in the side walls of the blank.

A folding device 26 is arranged at the folding station 17 and above the conveyor 12, this being engaged by the upper portion of the side flaps 23, as the loaded partly-erected carton sleeves are advanced to the station 17, so as to fold the upper margins of the side flaps 23 inwardly into overlapping relation in order to complete the formation of the carton sleeve, as shown in FIG. 2*d*. An adhesive applicator in the form of a hot jet adhesive applicator 27 is arranged to co-operate with the folding device 26, and applies a line of hot melt adhesive on the underlying side flap 23*a* of the top closure of the sleeve, the uppermost side flap 23*b* being pressed down onto the line of adhesive during the final stages of treatment of the carton sleeve by the folding device 26 as it leaves the latter prior to passage to a discharge chute 31 at the discharge station 18.

In order to achieve an orderly supply of blanks 11, one by one, into the path of the flights 13 of the conveyor 12, the magazine 19 has two separate guide portions, in which a first guide portion 32 extends substantially vertically upwardly from the path of travel of the conveyor 12, and a second guide part 33 extends upwardly and rearwardly with respect to the direction of travel of the conveyor. By this arrangement of the magazine, the blanks 11 undergo relative longitudinal/horizontal displacement as they descend through the second guide part 33 to the first guide part 32, and this feature assists in the separation of the blanks so as to prevent adhesion (by friction, partial vacuum, or board interlocking) between them, whereby they can be readily discharged, one by one, from the first guide part 32 into the path of travel of the flights 13 by downward movement of the suction heads 20.

Figure 3:
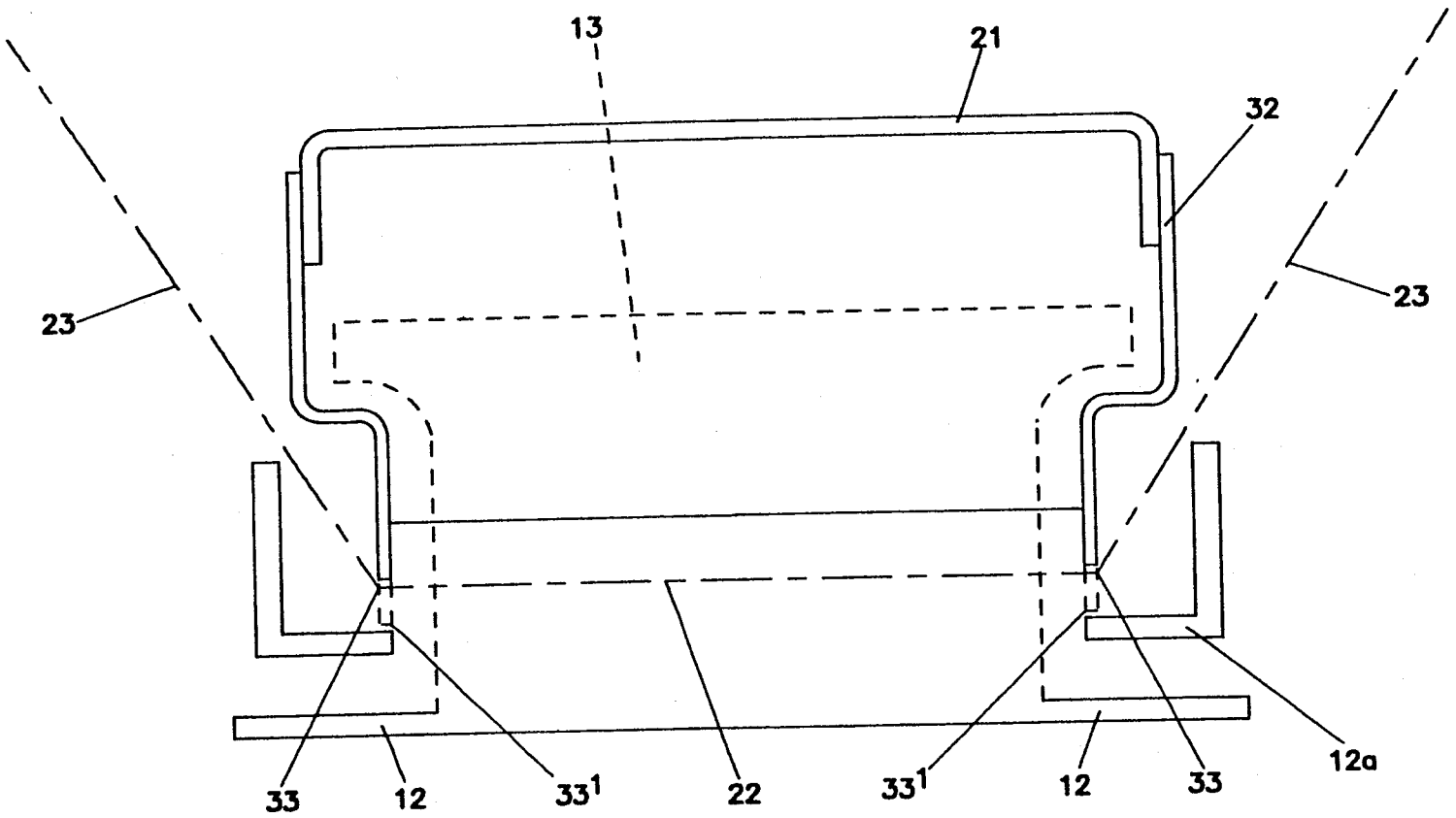
FIG. 3 is a transverse view of the upstream end of the machine, adjacent to a magazine for supplying blanks to the machine.

FIG. 3 shows in more detail the initial formation of each blank, which is drawn downwardly from the magazine 19 and is then moved along the upper run of the conveyor 12 by one of the flights 13 into engagement with the forming device 21, which takes the form of an inverted generally U-shaped box member 32. The lower edge 33 of the member 32 tapers so as to approach the rails 12*a*, in the direction of motion of the upper run of the conveyor, so as to cause the base 22 of the blank to approach progressively the rails 12*a* (the lowest part of edge 33 is shown by reference 33 prime). During this downward and forward movement of the base 22 the side flaps pivot upwardly, and this may be further assisted by guide bars, rods or plates (not shown) alongside the member 32, which forms a type of "folding box". The now U-shaped and partly erected carton is now delivered to the loading station 16 to have product loaded therein. After completion of product loading, the partly-erected carton then travels to the final closing station 17, which is shown in more detail in FIGS. 4, 5 and 6.

Figure 4:
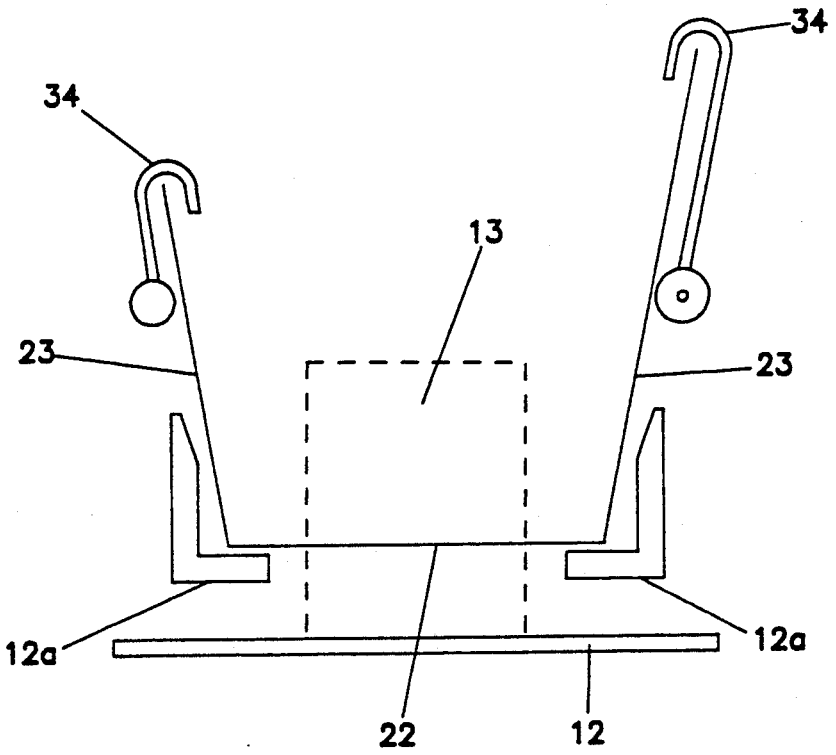
FIG. 4 is a transverse view near to the downstream end of the machine, and showing the initial part of the final stage of carton formation.
Figure 5:
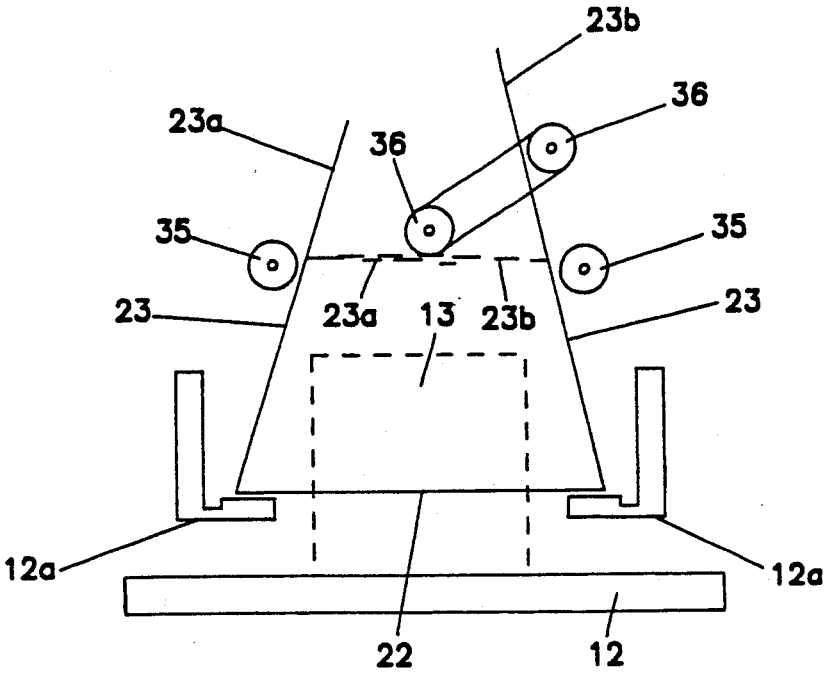
FIG. 5 is a transverse view of the downstream end of the machine showing the final stage of carton formation; and, FIG. 6 is a plan view showning guide rods for deforming the upwardly projecting sides of the blank during the final stages.
Figure 6:
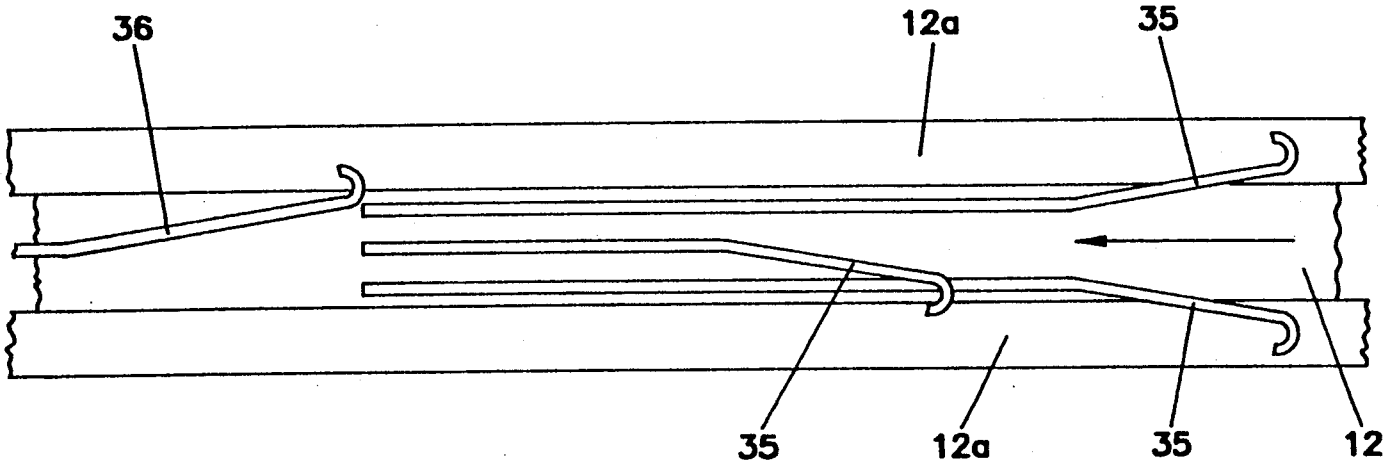

As shown in FIGS. 4 and 5, the side flaps 23 are guided by guides 34, 35 and 36 so as to be brough closer to each other for the final closing operation, which first folds the shorter edge flap 23*a* downwardly to the position shown in dotted lines in FIG. 5, so as to be ready to receive an adhesive strip from applicator 27, and then the longer edge flap 23*b* is folded downwardly to the dotted position in order to complete the closure of the carton, ready for discharge down the chute 31. To assist the final closing action, a horizontal guide plate may be arranged (not shown) to press the edge strips 23*a* and 23*b* together in the horizontal position.

The embodiment of sleeving machine is particularly suitable for the medium-speed packaging of foil, tinplated cans, plastics containers, pots, tubs and trays, in a one×two, one×three, one×four to two on two configuration, as desired. The machine functions automatically to wrap a suitable carton sleeve around the product.

Product containers having a diameter or width in the range 64 millimetres to 134 millimetres, and product height of 25 millimetres to 114 millimetres can be handled, and the length of the carton sleeve can be from 64 millimetres to 340 millimetres. It should be understood that these are only examples, and that sizes outside these ranges may also be acceptable subject, if necessary, to minor machine modifications. The speed of the machine can be selected from 11 to 55 sleeves per minute, though speed outside this range may be available subject to machine length for loading/number of operators required/pitch of machine/sleeve length.

The magazine can hold approximately 500 to 1000 sleeve blanks, depending upon the calibre of the blanks, with automatic vacuum pick-off and placement of the blanks into the flights of the slatband conveyor 12. The folding unit 21 is referred to as a "folding box unit", which is able to fold a flat blank into a U-shaped section. A length of about 1700 millimetres can be made available at the loading station 16, for two operators to load the partly erected containers with product. Although not shown in detail in FIG. 1, the folding unit 26 includes an overhead ploughing unit to partially fold the side flaps of the sleeve over the containers, and this is followed by hot melt jetting via the adhesive applicator 27, followed by final closure of each carton sleeve by an overhead compression unit (not shown) provided in the folding device 26, prior to discharge of the fully packed carton sleeves.

MACHINE OPERATION

Prior to start-up, the magazine is filled with flat blanks, and the hot melt jetting unit is brough up to temperature. Product containers are made available along one side of the machine, either on a conveyor or in bulk trays arranged on an inclined stand, and the operators are positioned so as to be able to pick up and place the product containers in the partly erected blanks. As the machine is running, blanks can be fed from the magazine at the discretion of the operator, or can be left to run continuously by switching-on or off a vacuum control valve. As the blanks issue from the magazine, they are folded into a U-shaped section and pass in front of the operator who places the product containers into the U-shaped sleeves. As the sleeves pass down the line, they are wrapped around the containers, and are held by means of hot melt jetting, prior to going through the overhead compression unit to discharge.

The folding unit 26, shown diagramatically only in FIG. 1, is a static unit, but it may be desirable to provide moveable carriage type guides and folders, which travel alongside the moving sleeve, in order to exert a particularly reliable, and readily repeatable inward folding and pressing action on the sleeves.

A further advantage of the inclined stacking provided by the magazine is that it reduces the effect of the full load of the stack of blanks on the bottom blank which is about to be withdrawn by the suction unit.

For product loading onto the bases 22 on the blanks, the product will normally be inverted with the closure tops facing downwardly (and projecting laterally through the cut-outs in the side walls). The partly erected blank will then travel along the guide rails 12*a* above the slat band conveyor 12.

However, for other types of product, it may be preferably for holes to be formed in the bases 22, through which the bases of tapering pots can extend so as to be supported directly by the slat band conveyor 12. The pots are then retained in position by a generally similar folding operation of the blank as described previously, but the pots are held captive against longitudinal movement by being seated in the holes in the bases 22.

If so-called double "lane" filling of carton sleeves is required, suitably larger blanks with pre-formed fold lines may be provided, with corresponding enlargement in width of the magazine, and the conveyor track and the folding device co-operating therewith, so as to form a wrap-around carton sleeve engaging two lanes of product i.e. side by side rows of product in one or two layers or tiers if required.

I claim:

1. A carton-packaging machine which is operable to cause progressive erection of carton sleeves from a supply of blanks, to permit loading of partly erected blanks with product, to complete the formation of a sleeve around each product and to close the latter with the product located therein, and to discharge the loaded sleeve from the machine, in which the machine comprises;

an endless conveyor moveable progressively through a blank-supply station, an erection station, a product-loading station, a folding station, and a discharge station;

a magazine arranged at the blank-supply station for holding a stack of blanks;

a suction device arranged to co-operate with the magazine and to operate in timed sequence with the operation of the conveyor in order to engage and draw blanks individually in turn, in flat form, into the path of travel of the conveyor for engagement thereby;

a shaping device arranged at the erection station and engageable by each blank in order to form the blank into a U-shape having a base and a pair of side flaps extending upwardly from the base, each U-shaped blank being then advanced by the conveyor to the loading station at which product can be loaded onto the base; and a folding device arranged at the folding station above the conveyor and engageable with the upper portion of the side flaps, as each loaded blank is advanced to the folding station, so as to fold the side flaps inwardly into overlapping relation in order to complete the formation of the carton sleeve; and rails extending alongside and above the upper run of the conveyor, the rails serving to support the base of the blank as it undergoes erection during travel along the conveyor.

2. A machine according to claim 1 in which the conveyor takes the form of a slatted conveyor having upwardly projecting flights spaced apart long the length of the conveyor.

3. A machine according to claim 1, including an adhesive applicator arranged to co-operate with the folding device in order to form a line of adhesive on the underlying one of the overlapping side flaps, prior to final pressing-down of the uppermost flap.

4. A machine according to claim 3, in which the adhesive applicator comprises a hot melt adhesive jetting device arranged to deliver, in timed sequence, a line of adhesive on the underlying side flap.

5. A machine according to claim 1 in which the magazine comprises a first guide portion which extends substantially vertically upwardly from the path of travel of the upper run of the conveyor, and a second guide portion which extends upwardly and rearwardly with respect to the direction of travel of the conveyor.

* * * * *